US006691771B1

(12) United States Patent
Shinhama et al.

(10) Patent No.: US 6,691,771 B1
(45) Date of Patent: Feb. 17, 2004

(54) CONDENSER

(75) Inventors: Masayoshi Shinhama, Tokyo (JP); Jinichi Hiyama, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/620,578

(22) Filed: Jul. 20, 2000

(30) Foreign Application Priority Data

Jul. 23, 1999 (JP) ..... P.11-209598

(51) Int. Cl.[7] ..... F25B 39/04
(52) U.S. Cl. ..... 165/132; 165/178; 62/509
(58) Field of Search ..... 165/132, 178; 62/509

(56) References Cited

U.S. PATENT DOCUMENTS 5,415,014 A * 5/1995 Waldschmidt et al. ..... 62/509
5,664,432 A 9/1997 O'Brien
5,901,573 A * 5/1999 Kobayashi ..... 165/132 X

FOREIGN PATENT DOCUMENTS

| | | |
|---|---|---|
| EP | 0 769 666 | 4/1997 |
| JP | 9-178298 | 7/1997 |
| JP | 9-257337 | 10/1997 |
| JP | 11-25479 | * 5/1999 |

* cited by examiner

*Primary Examiner*—Leonard Leo
(74) *Attorney, Agent, or Firm*—Foley & Lardner

(57) ABSTRACT

A plurality of cooling tubes (7) are connected and communicated with one another in multisteps in a vertical direction bridging a pair of header pipes (3). One of the header pipes (3) is provided with a liquid tank (9) for storing a cooling medium in a liquid phase which has been condensed and liquidized by cooling, and an auxiliary machinery part (23) is fitted to a peripheral wall face 9*a* of the liquid tank which serves as a large mounting face.

22 Claims, 5 Drawing Sheets

CONDENSER

BACKGROUND OF THE INVENTION

The present invention relates to a condenser which is employed in a refrigeration cycle in an air conditioning apparatus or the like for a vehicle.

The condenser which is employed in the refrigeration cycle in the air conditioning apparatus for the vehicle comprises a pair of header pipes. One of the header pipes is provided with a liquid tank for storing a cooling medium which has been condensed and liquidized by cooling, while the other header pipe is provided with auxiliary machinery parts such as a pressure switch, etc.

The auxiliary machinery parts such as the pressure switch are generally provided at some midpoints of a pipe which connects the header pipe and an expansion valve. Besides, it has been known that the auxiliary machinery parts are directly fitted to the header pipe without employing the connecting pipe, as disclosed in Japanese Publication No. JP-A-9-257337 of unexamined Patent In the former case in which the auxiliary machinery part is provided at a midpoint of the pipe, a block for fitting the auxiliary machinery part must be retrofitted to the pipe by welding. This will take additional working steps, and is not favorable in respect of both working steps and cost.

In the latter case in which the auxiliary machinery part is directly fitted to the header pipe, the auxiliary machinery part will be largely bulged outward from the header pipe. Therefore, the auxiliary machinery part is apt to interfere with other functional parts when it is installed in an engine room, and subjected to a serious restriction for installation. There still remains another problem, in some cases, that since there is no ample working space, a mounting work of a connecting coupler for sending a signal to the auxiliary machinery part will become worse.

For these reasons, it has been considered that the entire width of the condenser is reduced so that it may not bulge, which, however, will incur deterioration of radiation efficiency. It has been also considered that the auxiliary machinery part is mounted directly above the liquid tank. However, this will lead to another problem that an inner capacity of the liquid tank will be decreased.

SUMMARY OF THE INVENTION

In view of the above, an object of the invention is to provide a condenser which will overcome the above described problems.

In order to achieve the above described object, according to a first aspect of the invention, there is provided a condenser which comprises a plurality of cooling tubes connected and communicated with one another in multisteps in a vertical direction bridging a pair of header pipes, one of the header pipes being provided with a liquid tank for storing a cooling medium in a liquid phase which has been condensed and liquidized by cooling, characterized in that an auxiliary machinery part is fitted to a peripheral wall face of the liquid tank.

With this arrangement, a larger mounting area than that of the header pipe will be secured on the peripheral wall face of the liquid tank, and therefore, the auxiliary machinery part can be easily mounted. Moreover, the arrangement is very favorable in respect of allowability of mounting.

According to a second aspect of the invention, the auxiliary machinery part is disposed at a side of a front face of the condenser.

With this arrangement, a mounting work of the auxiliary machinery part after the condenser has been installed in an engine room can be easily conducted from a forward side of a front part of the engine room.

According to a third aspect of the invention, the auxiliary machinery part is mounted widthwise and disposed in proximity to a front face of the condenser.

With this arrangement, because a thickness of the condenser in a back and forth direction can be made small, the auxiliary machinery part can be mounted without reducing a heat radiation area of the condenser and an inner capacity of the liquid tank, and allowability of the installation space will be increased.

According to a fourth aspect of the invention, the auxiliary machinery part is fitted to a lower zone of the liquid tank.

With this arrangement, it will be possible to dispose the auxiliary machinery part in a stable cooling medium in a liquid phase, and therefore, measuring accuracy of the pressure switch or the like, for example, will be improved.

As described, according to the invention, the larger mounting area than that of the header pipe will be secured on the peripheral wall face of the liquid tank, and therefore, the auxiliary machinery part can be easily mounted. Moreover, the arrangement is very favorable in respect of the allowability of mounting.

Moreover, the mounting work of the auxiliary machinery part can be easily conducted from the forward side of the front part of the engine room, and the arrangement is very favorable in respect of workability.

Because the thickness of the condenser in the back and forth direction can be made small, and the auxiliary machinery part can be fitted to the lower zone of the liquid tank, the allowability of the installation space will be increased. It is also possible to dispose the auxiliary machinery part in the stable cooling medium in the liquid phase, and therefore, the measuring accuracy of the pressure switch or the like will be improved.

The present disclosure relates to the subject matter contained in Japanese patent application No. Hei. 11-209598 (filed on Jul. 23, 1999), which is expressly incorporated herein by reference in its entirety.

DESCRIPTION OF THE PREFERRED EMBODIMENT

Referring now to FIGS. 1 to 7 of the drawings, a first embodiment of the invention will be described in detail hereunder.

Figure 1:
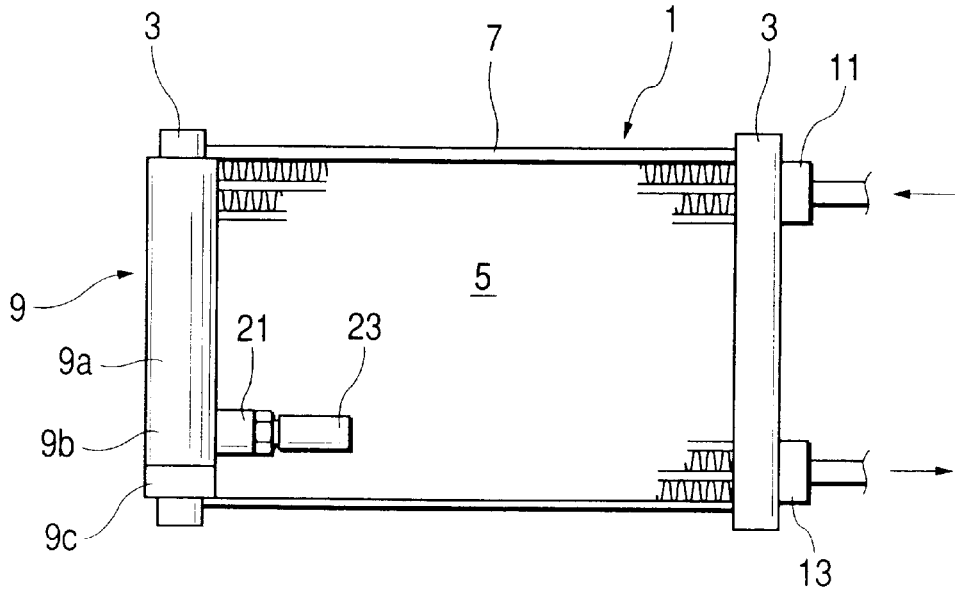
FIG. 1 is a schematic front view of a condenser according to the invention.

In FIG. 1, reference numeral 1 designates a condenser. The condenser 1 includes a pair of left and right header pipes 3, and cooling tubes 7 with fins which are connected and communicated with one another in multisteps in a vertical direction bridging both the header pipes 3 to constitute a cooling core 5.

Figure 2:
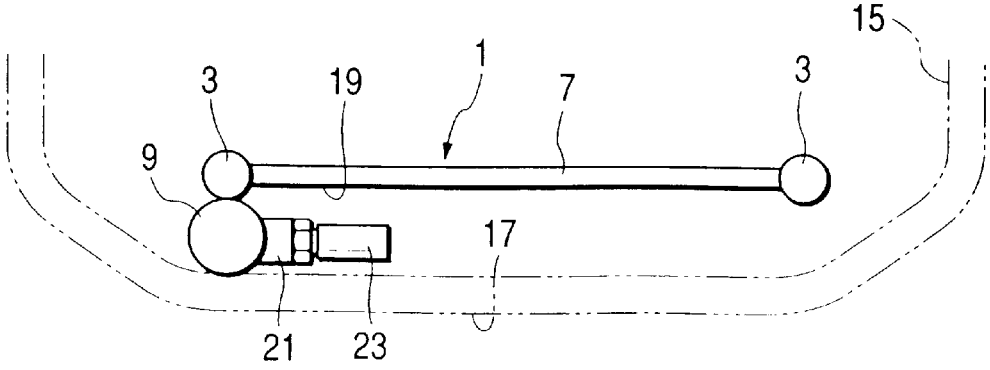
FIG. 2 is a schematic plan view of the condenser disposed in an engine room.
Figure 3:
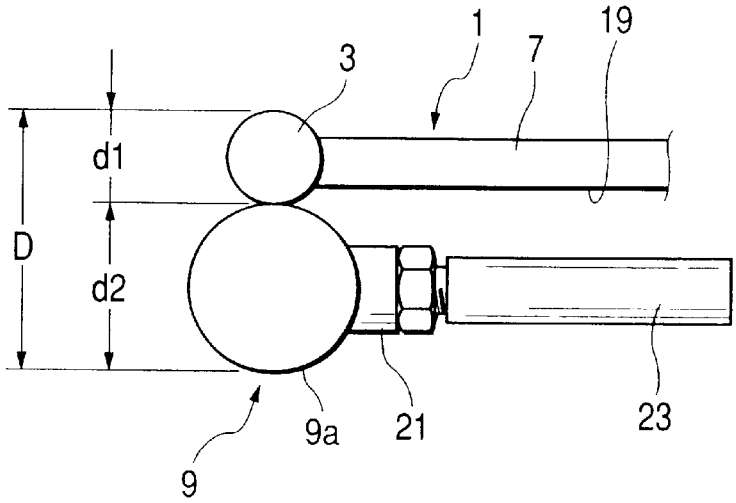
FIG. 3 is an enlarged plan view of a pressure switch fitted to a peripheral wall face of a liquid tank.

One of the header pipes 3 of the condenser 1 is provided with a liquid tank 9, and the other header pipe 3 is provided with an inlet 11 and an outlet 13 for a cooling medium. As shown in FIG. 2, the condenser 1 is installed at a foremost position in a front part of an engine room 15 in such a manner that a front face 19 of the condenser 1 is exposed at a front face of the engine room to which a front grille 17 is attached.

The condenser 1 is adapted to cool a cooling medium in a gas phase having high temperature and high pressure which is introduced from a compressor located outside the drawings into the header pipes 3 through the cooling medium inlet 11, thereby to condense and liquidize the cooling medium. The condensed and liquidized cooling medium in a liquid phase is collected in one of the header pipes 3, and then stored in the liquid tank 9.

In the liquid tank 9 are incorporated a drying agent for absorbing water in the cooling medium in the liquid phase, and a filter for removing small foreign substances contained therein, both of which are not shown in the drawings. The liquid tank 9 is in a form of a cylinder vertically elongated and having a diameter larger than that of the header pipe 3.

The liquid tank 9 is attached to a front face (at a lower side in FIG. 2) of the one headerpipe 3, and an auxiliary machinery part such as a pressure switch 23 is attached to a lower side of a peripheral wall face 9*a* of the liquid tank 9 by way of a connecting block 21. In addition, the liquid tank 9 is made up of a cylindrical body 9*b* and a lid 9*c* fixedly or removably attached to the cylindrical body 9*b*, and the cylindrical body 9*b* and the lid 9*c* define the peripheral wall face 9*a* of the liquid tank 9. That is, the auxiliary machinery part may be attached to a part of the peripheral wall face 9*a* of the liquid tank 9 which is defined by the cylindrical body 9*b* of the liquid tank 9 or to a part of the peripheral wall face 9*a* of the liquid tank 9 which is defined by the lid 9*c* of the liquid tank 9.

Function of the pressure switch 23 is to detect pressure of the cooling medium in the liquid phase in the refrigeration cycle and to turn on or off an electromagnetic switch for actuating the compressor outside the drawings according to a detected signal by way of a signal cable, or to control adjustment of capacity of the compressor.

The pressure switch 23 is mounted widthwise (in a lateral direction in FIG. 3) in proximity to the front face 19 of the condenser 1, and accommodated within the diameter of the liquid tank 9.

Figure 5:
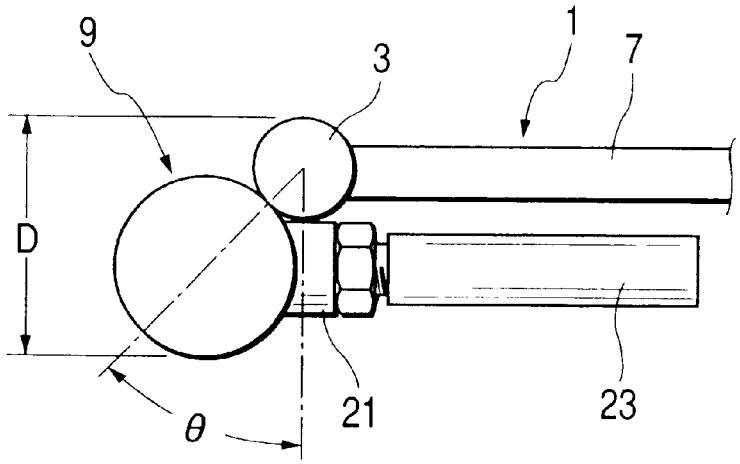
FIG. 5 is an explanatory view of the liquid tank displaced at a determined angle with respect to a header pipe.

In this way, an overall thickness D of the condenser 1 can be set within a size consisting of a thickness d1 of a main body of the condenser 1 plus the diameter d2 of the liquid tank 9, and therefore, the condenser 1 can be designed to be small in a direction of the thickness D. In this case, when the condenser 1 is installed in the engine room 15, the liquid tank 9 may be disposed at a position which is displaced outward from the front face at a determined angle θ with respect to the header pipe 3 as shown in FIG. 5, depending on a relative mounting space according to a type of the vehicle.

Figure 6:
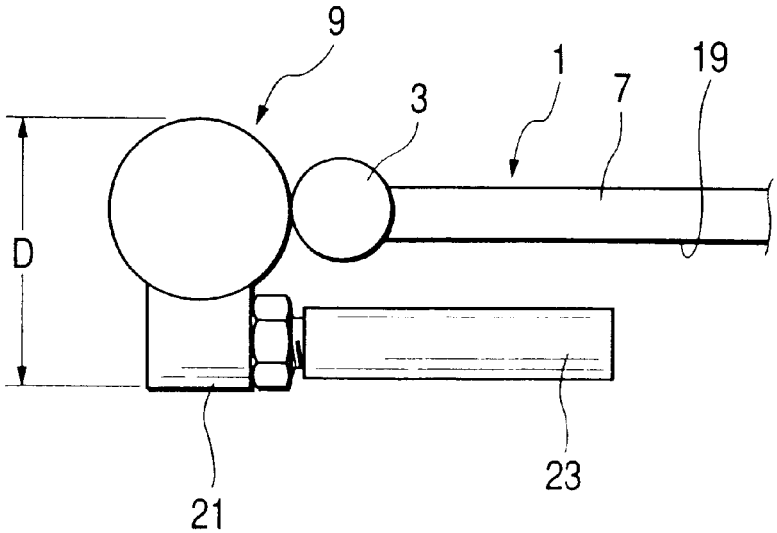
FIG. 6 is an explanatory view of the liquid tank fitted just to the side of the header pipe on a same axis.

Alternatively, the liquid tank 9 may be fitted just to the side of the header pipe 3 on a same axis as shown in FIG. 6.

In this embodiment, the connecting block 21 of such a type that a fitting portion for fitting the pressure switch 23 is provided on its inner side face (on the right hand in the drawing) is employed, and bonded to the front face (a lower side in the drawing) of the liquid tank 9 by brazing. This arrangement enables the pressure switch 23 to be mounted in proximity to the front face 19 of the condenser 1 by fitting the pressure switch 23 to the fitting portion of the connecting block 21. Thus, the overall thickness D can be made small.

Figure 4:
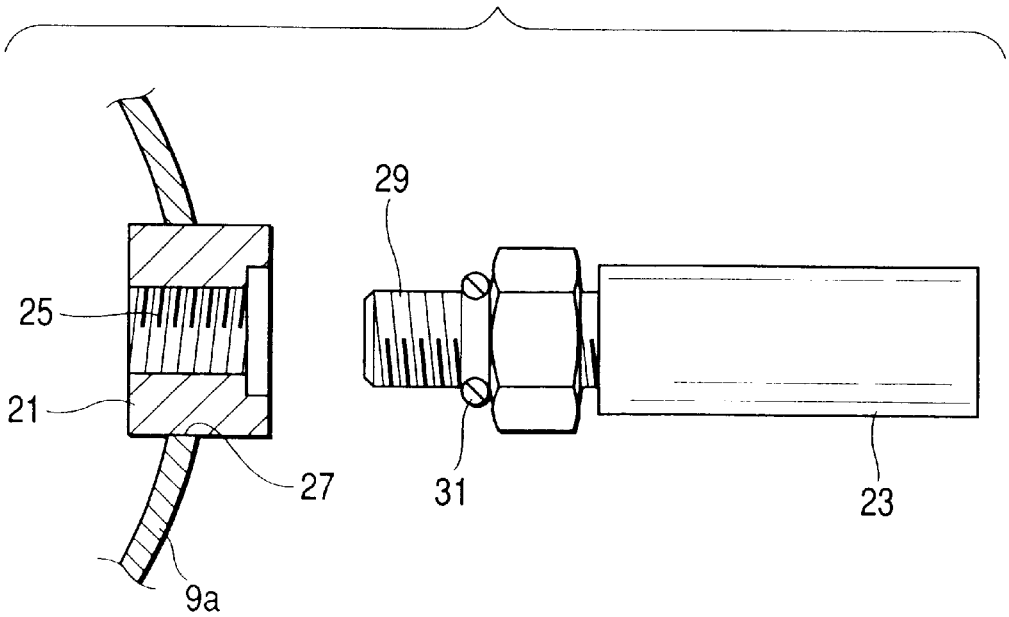
FIG. 4 is an explanatory view showing a state where the pressure switch is detached from a connecting block.

The connecting block 21 for fitting the pressure switch 23 has a female screw thread 25 which serves as a portion to be fitted in an interior thereof, as shown in FIG. 4. The connecting block 21 is inserted into a mount hole 27 which is formed in a peripheral wall 9*a* of the liquid tank 9 and integrally fixed by brazing around the inserted area.

The female screw thread 25 of the connecting block 21 is screw-threadedly engaged with a male screw thread 29 formed at a distal end of the pressure switch 23, and the engaged area is kept in a sealed condition by means of a sealing member 31 such as an O-ring.

Figure 7:
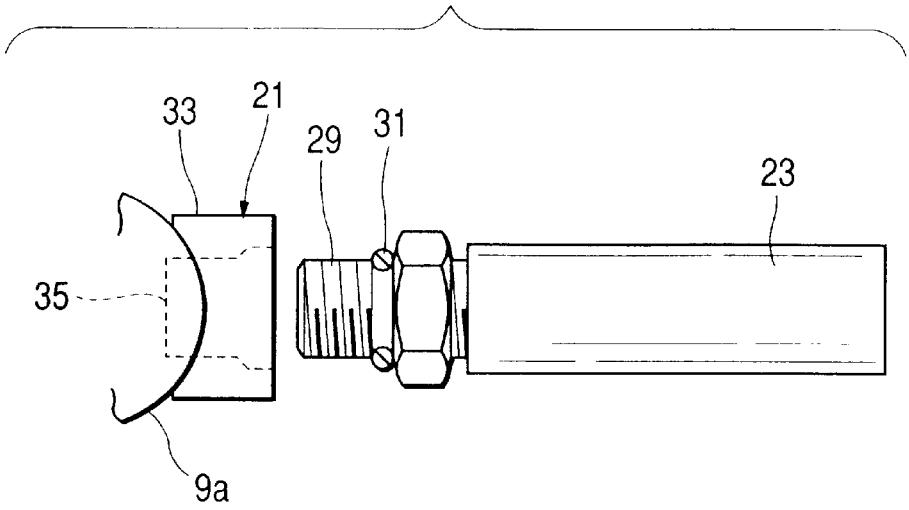
FIG. 7 is an explanatory view similar to FIG. 3 showing a modified example of the connecting block.

As shown in FIG. 7, the connecting block 21 may be composed of an outer cylindrical portion 33, and an integral inner cylindrical portion 35 which is bent into the interior from the outer cylindrical portion 33. An arcuate outer peripheral face of the outer cylindrical portion 33 is abutted against the peripheral wall face 9*a* of the liquid tank 9, and the abutted faces are integrally brazed. Meanwhile, a distal end of the inner cylindrical portion 35 may be inserted into the liquid tank 9, and the female screw thread 25 to be engaged with the male screw thread 29 of the pressure switch 23 may be provided on an inner face of the inner cylindrical portion 35.

In the condenser 1 constructed in this way, the pressure switch 23 can be fitted to the peripheral wall face 9*a* of the liquid tank 9 from a forward side of the front part of the engine room 15. Accordingly, the mounting work can be conducted easily and the capacity of the liquid tank 9 will not be decreased. Moreover, mounting allowability will be increased because of the larger mounting space.

Further, because the pressure switch 23 is arranged in proximity to the front face 19 of the condenser 1 within the diameter of the liquid tank 9, the overall thickness D can be thin without decreasing the heat radiation area of the condenser 1. As the results, allowability of the installation space will be increased, and the condenser 1 can be provided at a position where the mounting work can be conducted easily.

In the meantime, the cooling medium in the gas phase introduced from the cooling medium inlet 11 is cooled while passing the cooling tubes 7 and condensed to be liquidized. While the cooling medium in the liquid phase which has been condensed and liquidized passes through the liquid tank 9, the water and the small foreign substances are removed, and then, the cooling medium flows toward the cooling medium outlet 13. During these movements, the pressure switch 23 conducts measurements in the cooling medium in the liquid phase in which the cooling medium is more stable than in a two-phase zone of both gas and liquid which will be a factor of an outer turbulence, and therefore, the measuring accuracy will be enhanced.

Figure 8:
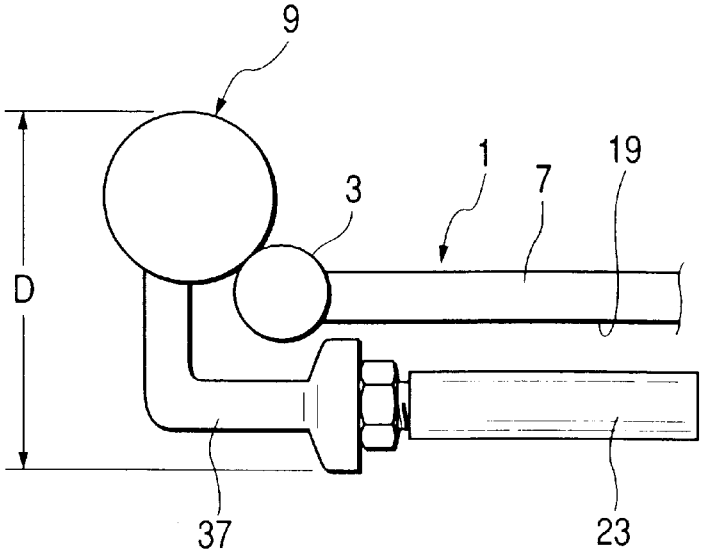
FIG. 8 is an explanatory view similar to FIG. 3 showing a second embodiment wherein the pressure switch is fitted to the liquid tank by way of a pipe.
Figure 9:
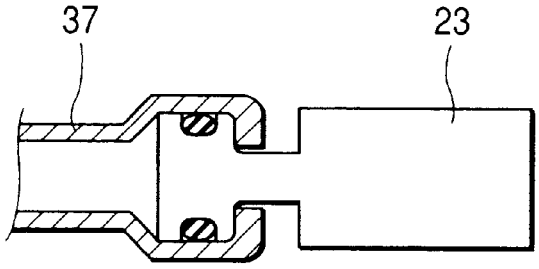
FIG. 9 is an explanatory view showing an example of the pipe of FIG. 8 and the pressure switch in an engaged state.

FIGS. 8 and 9 show a second embodiment in which the pressure switch 23 is fitted to the liquid tank 9 by way of a pipe 37.

One end of the pipe 37 is brazed to the liquid tank 9 which has been fitted to an outward side face of the header pipe 3 in the backward thereof, while the other end of the pipe 37 is extended in proximity to the front face 19 of the condenser 1. The distal end of the pressure switch 23 is integrally fitted by caulking to an extended end of the pipe 37, as shown in FIG. 9.

Other constituent elements are the same as in the first embodiment, and denoted with the same reference numerals to omit a detailed explanation.

Accordingly, in this second embodiment, even in case where the mounting position of the liquid tank 9 is restricted and it is difficult to fit the pressure switch 23 directly to the liquid tank 9, a forwardly bulged amount can be made small by means of the pipe 37. Therefore, the overall thickness D of the condenser 1 can be made thin.

Figure 10:
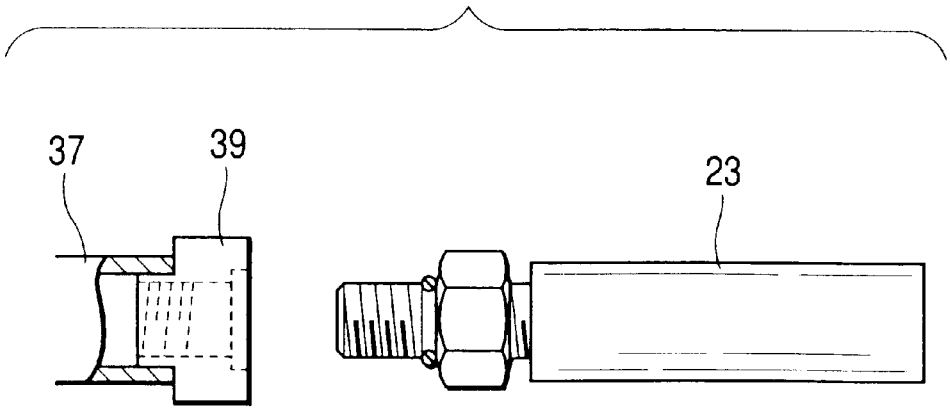
FIG. 10 is an explanatory view showing another example of the pipe of FIG. 8 and the pressure switch in an engaged state.

A similar effect can be expected by fixing a connecting block 39 to an end of the pipe 37 which is extended in proximity to the front face 19 of the condenser 1 and by fitting the pressure switch 23 to the connecting block 39 as shown in FIG. 10.

Although the pressure switch 23 has been described as the auxiliary machinery part in the first and the second embodiments, the auxiliary machinery part may include a charge valve for charging the cooling medium into the cycle, or a fusible plug which will be fused to relieve a pressure in the cycle to the exterior when an ambient temperature has risen excessively for some reason.

What is claimed is:

1. A condenser comprising:

a pair of header pipes;

a plurality of cooling tubes connected and communicated with one another in multisteps in a vertical direction, said cooling tubes bridging one of said pair of header pipes to the other of said pair of header pipes;

a liquid tank, provided on the one of said header pipes and abutting with the one header pipe, for storing a cooling medium in a liquid phase which has been condensed and liquefied by cooling; and an auxiliary machinery part adapted to be fitted to a peripheral wall face of said liquid tank, wherein said liquid tank and said abutting one header pipe have an overall thickness, and said auxiliary machinery part is positioned to extend entirely within the overall thickness, and wherein said auxiliary machinery part is positioned within a width between the liquid tank and the other header pipe.

2. A condenser as claimed in claim 1, wherein said auxiliary machinery part is disposed at a side of a front face of said condenser.

3. A condenser as claimed in claim 1, wherein said auxiliary machinery part is mounted widthwise so as to extend in a direction of the width between the liquid tank and the other header pipe and in proximity to a front face of said condenser.

4. A condenser as claimed in claim 1, wherein said auxiliary machinery part is fitted to a lower zone of said liquid tank.

5. The condenser of claim 1, further comprising a connecting block, wherein said auxiliary machinery part is fitted to said peripheral wall face of said liquid tank through said connecting block.

6. The condenser of claim 5, wherein said connecting block extends in a direction substantially parallel to said cooling tubes.

7. The condenser of claim 1, wherein said auxiliary machinery part comprises a pressure switch.

8. The condenser of claim 7, wherein the other of said header pipes comprises an inlet and an outlet, and wherein said pressure switch performs measurements on said cooling medium when it is liquefied.

9. The condenser of claim 1, wherein said auxiliary machinery part comprises a charger valve.

10. The condenser of claim 1, wherein said auxiliary machinery part comprises a fusible plug.

11. The condenser of claim 1, further comprising an interconnecting pipe, wherein said auxiliary machinery part is fitted to said peripheral wall face of said liquid tank through said interconnecting pipe.

12. The condenser of claim 11, wherein said interconnecting pipe is fitted to said auxiliary machinery part by caulking.

13. A condenser comprising:

a pair of header pipes;

a plurality of cooling tubes connected and communicated with one another in multisteps in a vertical direction, said cooling tubes bridging said pair of header pipes;

a liquid tank, provided on one of said header pipes, for storing a cooling medium in a liquid phase which has been condensed and liquefied by cooling; and an auxiliary machinery part adapted to be fitted to a peripheral wall face of said liquid tank, wherein said auxiliary machinery part extends in a direction substantially parallel to said cooling tubes.

14. The condenser of claim 13, wherein said auxiliary machinery part is disposed at a front face of the condenser.

15. The condenser of claim 13, wherein said auxiliary machinery part is fitted to a lower zone of said liquid tank.

16. The condenser of claim 13, further comprising a connecting block, wherein said auxiliary machinery part is fitted to said peripheral wall face of said liquid tank through said connecting block.

17. The condenser of claim 16, wherein said connecting block extends in a direction substantially parallel to said cooling tubes.

18. The condenser of claim 13, wherein said auxiliary machinery part comprises a pressure switch, said pressure switch performing measurements on said cooling medium when it is liquefied.

19. The condenser of claim 13, wherein said auxiliary machinery part comprises a charger valve.

20. The condenser of claim 13, wherein said auxiliary machinery part comprises a fusible plug.

21. The condenser of claim 13, further comprising an interconnecting pipe, wherein said auxiliary machinery part is fitted to said peripheral wall face of said liquid tank through said interconnecting pipe.

22. The condenser of claim 21, wherein said interconnecting pipe is fitted to said auxiliary machinery part by caulking.

* * * * *